United States Patent [19]

Klapdar et al.

[11] 3,992,195

[45] Nov. 16, 1976

[54] PROCESS FOR THE PRODUCTION OF STEEL WITH INCREASED DUCTILITY

[75] Inventors: Wilhelm Klapdar, Essen; Helmut Richter, Oberhausen; Heinrich-Wilhelm Rommerswinkel, Mulheim; Edgar Spetzler; Jochen Wendorff, both of Oberhausen, all of Germany

[73] Assignee: Thyssen Niederrhein AG Hütten- und Walzwerke, Oberhausen, Germany

[22] Filed: Apr. 18, 1975

[21] Appl. No.: 569,150

[30] Foreign Application Priority Data

Apr. 20, 1974 Germany ..... 2419070

[52] U.S. Cl. ..... 75/58; 75/53

[51] Int. Cl.[2] ..... C21C 7/02

[58] Field of Search ..... 75/53, 57, 58, 51, 52

[56] References Cited

UNITED STATES PATENTS

| | | | |
|---|---|---|---|
| 2,803,533 | 8/1957 | Bieniosek | 75/55 |
| 3,258,328 | 6/1966 | Goss | 75/53 |
| 3,567,432 | 2/1971 | Wardell | 75/58 |
| 3,575,695 | 4/1971 | Miyashita | 75/58 |
| 3,598,573 | 8/1971 | Freissmuth | 75/53 |
| 3,876,421 | 4/1975 | Takemura | 75/53 |
| 3,885,957 | 5/1975 | Richter | 75/53 |

*Primary Examiner*—Peter D. Rosenberg
*Attorney, Agent, or Firm*—Karl F. Ross; Herbert Dubno

[57] ABSTRACT

A process for the production of steel with increased ductility in which a sulfur-containing steel melt is deoxidized and, if desired, is supplied with alloying elements, the deoxidized melt is treated with calcium as part of a purification action simultaneously reducing the sulfur content and the reaction is carried out in a casting ladle having a lining free from siliceous oxides. The melt is covered with a synthetic slag free from siliceous oxides and the calcium-containing substance is introduced in fine-grain particulate form into the melt in a carrier gas at a level at least 2000 mm below the melt surface and at a rate which is less than the maximum rate at which the calcium-containing substance is capable of reacting with the melt.

5 Claims, 1 Drawing Figure

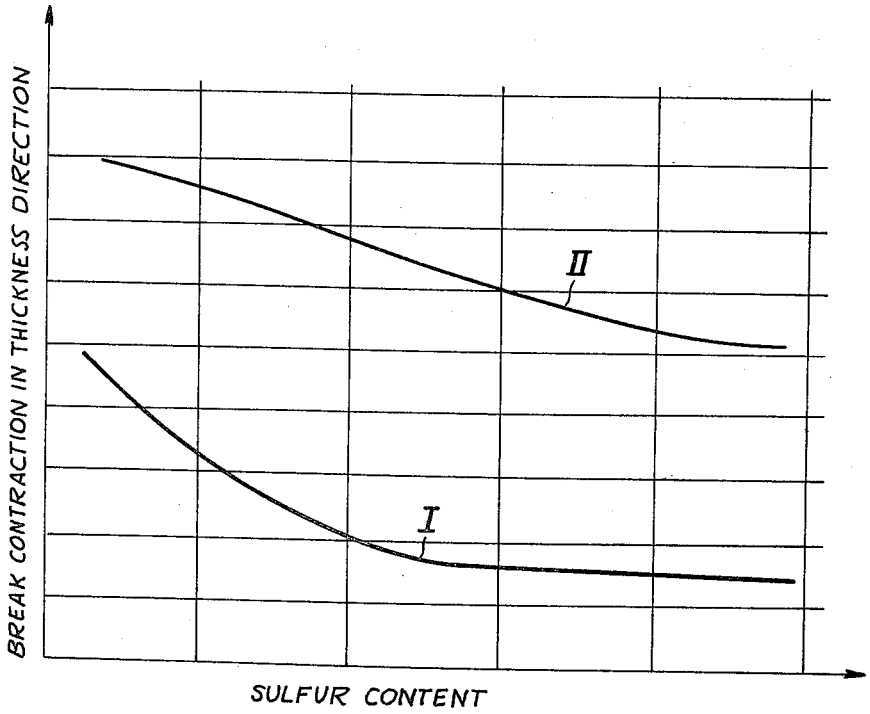
BREAK CONTRACTION IN THICKNESS DIRECTION
II
I
SULFUR CONTENT

PROCESS FOR THE PRODUCTION OF STEEL WITH INCREASED DUCTILITY

FIELD OF THE INVENTION

The present invention relates to a process for the production of steel with increased ductility and especially with increased contraction of the steel upon the application of tensile stress thereto, starting with a sulfur-containing melt.

BACKGROUND OF THE INVENTION

Steel melts, prior to casting into ingots and rolling, are commonly subjected to a deoxidation and desulfurization treatment which may be supplemented by or can, in part, involve the treatment of the steel melt with calcium-containing treating agents capable of purifying the melt and reducing the sulfur content thereof.

The calcium-containing treatment agent may be finely divided (fine grain) calcium, calcium compounds such as calcium carbides, and calcium alloys or compounds such as calcium-silicon which contains 30% by weight calcium, 60% silicon and 10% iron, or the like. Other treatment agents which may be used can contain, in addition to silicon, elements such as aluminum and manganese. The carrier gas should be a neutral or inert substance such as argon.

In conventional processes the treatment of the melt with calcium-containing agents is generally carried out with a constant equilibrium between supply of the agent and consumption thereof by the purification of action. The thermodynamic and reaction-kinetic parameters of the system determine the maximum rate at which the calcium-containing treatment agent is capable of reaction. The above-mentioned equilibrium is achieved when this rate is equalled by the rate at which the calcium-containing agent is supplied to the melt. Whatever calcium-containing agent is supplied to the melt, therefore, is immediately reacted therewith.

This system has the advantage over still older processes, in which the calcium-containing treatment agent in a predetermined quantity (for example an amount of 2 or more kg/ton of the melt) is introduced in a single step and altogether into the melt. In the latter case some of the calcium-containing agent or the calcium thereof is evaporated without having undergone reaction with the melt and hence the equilibrium process manifests a saving of the treatment agent. Desulfurization is also improved by the equilibrium method.

However, the ductility characteristics of the manufactured steel, measured in terms of the break contraction is so high as to be undesirable and it has been found that the isotropy of the ductility characteristics of the steel requires improvement. For the purpose of the present application, the term "break contraction" will be used to refer to the contraction of a dimension of the manufactured steel body under tension at rupture and is measured by the relationship $$\psi = \frac{(d-d')}{d} \times 100$$

and is given in percent; $d'$ is the linear dimension at break, $d$ is the corresponding dimension prior to the application of tensile stress to the body. An increased percentage value of the break contraction corresponds to improved ductility.

OBJECT OF THE INVENTION

It is the principal object of the present invention to provide an improved process for producing steel of high ductility (increased break contraction) and improved isotropy of the ductility characteristics.

DESCRIPTION OF THE INVENTION

This object and others which will become apparent hereinafter are attained in accordance with the present invention which provides a process for the production of steel of improved ductility (especially break contraction) whereby a sulfur-containing starting steel melt is deoxidized and, if desired, is alloyed with alloying elements, and the oxidized steel melt is subjected to treatment with a calcium-containing treatment agent in a purification reaction with reduction of the sulfur content.

According to the invention, the process is carried out in a casting ladle whose lining is free from siliceous oxides and after the melt has been covered with a synthetic slag free from siliceous oxides.

The calcium-containing treating agent is introduced into the melt in fine-grain particulate form at a depth of at least 2000 mm below the surface of the melt in a neutral carrier gas.

The calcium-containing treatment agent is fine-grain elemental calcium or a fine-grain calcium compound such as calcium alloy. Best results are obtained with calcium carbide or calcium-silicon consisting of 30% by weight silicon and 10% by weight iron. Other treatment agents which are suitable include calcium and silicon and in addition can include aluminum and manganese. As noted, the carrier gas is preferably argon.

The lining of the casting ladle may consist of magnesite, alumina, dolomite or mixtures thereof. The slag can consist of calcium oxide (CaO), calcium fluoride ($CaF_2$) or aluminum oxide ($Al_2O_3$). The slag should contain less than 5% by weight of FeO, $SiO_2$ and MnO.

An important aspect of the invention is that the introduction of the calcium-containing treatment agent is carried out in deficiency and will be defined below.

The invention will be best understood in the context of a brief review of the state of the art.

It is known that calcium is an extremely strong deoxidation and desulfurization agent for steel melts. However, the utilization of calcium for the deoxidation and desulfurization reactions is relatively small because of the high vapor pressure of this element and the temperature of the molten steel. Furthermore, it has been recognized that the use of calcium in the form of alloys, which generally contain silicon, aluminum and manganese, brings about a modification and removal from the oxide inclusions in the steel, thereby improving the degree of purity of the steel, its ductility in terms of break contraction, and a reduction of the deformation-related anisotropy of the steel body.

When the technique of blowing the calcium into the melt was developed it was intended to promote the utilization of the calcium in the deoxidation and desulfurization process so that smaller quantities of calcium could be used. The prime use of this improved process was intended for the purification of steel from oxidic inclusions while the desulfurization, because of the limited calcium addition, was a side effect.

In another process (see German Offenlegungsschrift No. 2,209,902) it was possible to optimize the calcium utilization for desulfurization while the oxide modification and breakdown of the oxides in the steel bath was a side effect.

However, the art recognized that the calcium in the melt could not be uniformly distributed so that the yield was relatively low (see NEUE HUTTE, 1971, page 73 upper right).

Neither with the usual approach to adding calcium to the melt nor by the improved processes with increased calcium utilization, however, was it possible to obtain desulfurization, reduction and modification of the oxide content, and improvement of the break contraction of the steel, i.e. its ductility characteristics. Such a combination of effects, however, was not to be expected since the oxides and the sulfides appear to function similarly with respect to the ductility characteristics. The quantities of calcium treatment agents required for the purification reaction were, as a rule, determined by the stoichiometry of the system (see *M. WAHLSTER, A. CHOUDHURY, H. KNAHL, A. FREISSMUTH, RODEX RUNDSCHAU* (1969) Vol. 2, pages 478 to 494).

The invention is based upon the discovery that steel of increased ductility (especially higher break contraction) can be obtained from a sulfur-containing starting steel melt under the conditions set forth above, i.e. whereby the steel melt is deoxidized and, if desired, is supplied with alloying elements, and the deoxidized steel melt is treated with a calcium-containing agent in the sense of a purification reaction with simultaneous reduction in the sulfur content. The result is achieved by a combination of factors:

a. the reaction is carried out in a casting ladle with a lining free from siliceous oxides;
b. the reaction is carried out with a melt covered by a synthetic slag free from siliceous oxides (i.e. containing less than 5% by weight $SiO_2$);
c. the quantity of calcium-containing treating agent necessary for the purification treatment is used (i.e. the total quantity is the stoichiometric quantity);
d. the treating agent is introduced into the melt in fine-grain form and at a depth of at least 2000 mm in a neutral carrier gas; and
e. the treatment agent is introduced in deficiency for the purification reaction.

In the conventional process, where the quantity of the calcium-containing treating agent is introduced into the steel melt, and this quantity exceeds the quantity which can react over the time interval during which it was added, a significant proportion of the calcium is vaporized and lost from the reaction. The present invention avoids this by ensuring the maintenance of a deficiency between the rate at which the treating agent is added and the rate at which the reaction can proceed under the thermodynamic and reaction-kinetic conditions in the melt. Thus, if the rate R at which a quantity Q can react is defined as $$R = \frac{dq}{dt} \quad \text{and } Q = \int R dt,$$

the rate at which the calcium-containing compound or other substance is added to the meld according to the present invention is given as $R' < R$, although the necessary quantity $Q = \int R' dt$ remains the same.

Surprisingly, the reaction proceeding in accordance with the present invention gives significantly different results from one in which all of the calcium is added at once or the calcium is added at the rate at which it reacts. More specifically, the steel manufactured in accordance with the present invention is found to possess a substantially higher break contraction than that which would be expected from its sulfur content. Furthermore, the isotropy of the mechanical properties of the manufactured steel after rolling is significantly better.

According to another feature of the invention, deoxidation is carried out in the casting ladle as the treatment with the calcium-containing agent. However, it is also possible to carry out deoxidation and, if desired, the introduction of alloying elements, in one casting ladle and to use a second casting ladle for the treatment with the calcium-containing agent.

Finally, it is possible in accordance with the present invention, to carry out deoxidation in one casting ladle and to carry out alloying and the calcium treatment in another.

The introduction of the calcium-containing treating agent can be effected through the bottom of the casting ladle or by means of lances which are thrust through the slag layer below the surface of the melt.

The deoxidation itself, which is carried out prior to calcium treatment under deficient conditions, is effected in conventional manner, e.g. by the introduction of CaSi alone or in combination with other deoxidation elements such as silicon, manganese, aluminum, titanium.

It has also been found to be possible to introduce other alloying elements into the melt after the deficiency calcium treatment. These alloying elements can be those which have a high oxygen affinity so that they would normally serve a deoxidation purpose. These elements include manganese, silicon, titanium, zirconium and aluminum. However, because of the prior reduction of the soluble oxygen content of the melt, these elements have little, if any, deoxidizing effect.

According to still another feature of the invention, the calcium-containing treatment agent is introduced under efficiency conditions for a period sufficient to reduce the sulfur content to below 0.015% by weight and preferably to below 0.010% by weight.

The invention also is effective when the introduction of the calcium-containing treatment agent, under deficiency conditions, is carried out until the degree of desulfurization has reached at least 60%.

It has been found that the calcium-containing treatment agent is most effective when introduced at the greatest possible depth in the steel melt (see German Offenlegungsschrift No. 2,290,902) and preferably at a depth beyond 2000 mm and in the region of about 2700 mm or more below the surface of the melt. The calcium-containing treatment agent should be introduced over a period of at least five minutes in an amount of more than 0.6 kg of calcium per ton of steel for maximum effectiveness.

The invention is based upon the discovery that conventional processes for deoxidation and desulfurization by calcium have not been able heretofore to significantly improve the ductility characteristics or reduce the anisotropy of the mechanical properties of the resulting bodies. The conventional processes are also characterized by inapplicability to many melt compositions and have high losses of calcium. It is surprising, therefore, that steel melts can be desulfurized by blowing calcium compounds into them in a basic-lined ladle from about 0.02% by weight sulfur to 0.005% by weight sulfur in 8 – 10 minutes according to the invention with significant improvement in the ductility and isotropy over steels which are treated with the same quantity of calcium to the same final sulfur content in three minutes.

Furthermore, it has been found that steel bodies made from steels which have been desulfurized from about 0.025% by weight sulfur to about 0.010% by weight sulfur, according to the invention, have higher ductility than those which in the same time but be reduced calcium addition are desulfurized from 0.015% by weight to 0.010% by weight.

It is also surprising that the improvement of ductility and isotropy described above according to the invention is not found when the treatment ladle is lined with clay or high aluminum materials containing 70% by weight $Al_2O_3$, balance $SiO_2$, such as mullite or bauxite. However, when the ladle is lined with magnasite, alumina containing more than 90% $Al_2O_3$ and preferably dolomite, the effect is observed when the degree of desulfurization exceeds 60%, the resulting sulfur content is below 0.012% by weight sulfur (preferably below 0.010% by weight sulfur) and the calcium is blown into the melt in a minimum quantity of 0.6 kg of calcium per ton of steel over a period of five minutes.

Microscopic investigations have shown that steel treated in accordance with the present invention no longer have manganese sulfide inclusions with sulfur contents of less than 0.012% by weight sulfur. The sulfidic impurity level is obviously brought substantially to zero and corresponds to that of sulfur-free steels. The total oxygen content of such steels is negligible and is generally less than 15 parts per million. Siliceous oxide-containing oxide inclusions are not found.

BRIEF DESCRIPTION OF THE DRAWING

The sole FIGURE of the accompanying drawing shows the relationship between sulfur content and break contraction in the direction of the thickness of a rolled body according to the invention.

SPECIFIC DESCRIPTION

In the drawing the sulfur content is given along the abscissa and the break contraction in percent of the sheet thickness for rolled steel sheet along the ordinate.

Curve I shows the dependency of the break contraction upon the sulfur content of steel produced by the conventional process while curve II represents the characteristic for an identical steel melt treated in accordance with the present invention with the identical quantity of treating agent. The sole difference between the two treatments is the duration over which the calcium treating agent was added, the duration being twice as long for the melt which gave rise to curve II than the duration of treatment for the melt producing the steel of curve I. For curve II the treatment was operated in deficiency as defined above whereas the treating agent was added at the rate of reaction for the steel of curve I.

SPECIFIC EXAMPLES

1. A comparison of the anisotropy of the notched-bar ductility at 20° C of steel of the Group St 52-3 with about 0.005% by weight sulfur showed that the process of the present invention gave rise to a steel made by the electroremelting process.

2. a comparison of steels of the Group 52-3 in the form of plates, which was subject to desulfurization by the blowing of calcium alloys into the respective steel melts at a depth of 2700 mm, showed clearly that with sulfur contents around 0.010% by weight sulfur both elongation and break contraction were improved by the present process over a process in which the calcium compound was added at a higher rate.

The melts, each 110 tons, were cast into billets following the treatment and rolled into plates.

In two melts (1 and 2) the desulfurization was effected by blowing calcium carbide into the melt over a period of three minutes. In melt (1), treated with 0.5 kg of calcium per ton of steel, the sulfur content was reduced from 0.032% by weight sulfur to 0.010% by weight sulfur or by 40.6%. In melt (2) 0.4 kg of calcium was used per ton of steel to reduce the sulfur content from 0.015% by weight sulfur to 0.010% by weight sulfur or by 33.3%. The ductility characteristics for elongation and break contraction in the sheet thicknesses are given in Table I.

TABLE I

| | δ 5 | Ψ |
|---|---|---|
| Melt 1: | 11% | 14.4% |
| Melt 2: | 16.1% | 34.1% |

Melts 3 and 4 were prepared by the introduction of calcium carbide over a period of about eight minutes for desulfurization. Melt 3 was treated with 0.8 kg of calcium per ton of steel to reduce the sulfur content from 0.046% by weight sulfur to 0.015% by eight sulfur or by 67%.

Melt 4 was treated with 0.8 kg of calcium per ton of steel to reduce the sulfur content from 0.036% sulfur to 0.009% sulfur or by 75%.

In spite of the comparable final sulfur contents by comparison to the melts (1) and (2), significantly higher values for the elongation and break contraction were obtained (Table II).

TABLE II

| | δ 5 | Ψ |
|---|---|---|
| Melt 3: | 30.1% | 61.4% |
| Melt 4: | 31.2% | 70.5% |

The improvement in the ductility characteristics in accordance with the present invention was better than 100%.

We claim:

1. A process for the production of steel of high ductility comprising the steps of: (a) deoxidizing a sulfur-containing starting steel melt; (b) maintaining the deoxidized steel melt in a ladle having a lining free from siliceous oxides; (c) covering said steel melt with a synthetic slag substantially free from siliceous oxides; (d) slowly injecting a calcium-containing treating agent in fine-grain particulate form into said melt at a depth of at least 2000 mm in a carrier gas to desulfurize and purify said melt; and (e) maintaining the rate of introduction of said calcium-containing agent in step (d) at most equal to the rate at which said agent is able to react with said melt, said agent being introduced into said melt over a period of at least five minutes in a total quantity of at least 0.6 kg of calcium per ton of steel.

2. The process defined in claim 1 wherein said agent is introduced in step (d) into said melt until the sulfur content thereof is reduced to a value below 0.015% by weight.

3. The process defined in claim 2 wherein said value is below 0.010% by weight.

4. The process defined in claim 1 wherein said agent is introduced in step (d) until the sulfur content of said melt has been reduced by at least 60%.

5. The process defined in claim 1 wherein said agent is introduced into said melt in step (d) at a depth of at least about 2700 mm.

* * * * *